US007018969B1

(12) United States Patent
Gross et al.

(10) Patent No.: US 7,018,969 B1
(45) **Date of Patent: *Mar. 28, 2006**

(54) THICKENERS FOR METHYL ESTER MICROEMULSIONS

(75) Inventors: Stephen F. Gross, Souderton, PA (US); John F. Hessel, Doylestown, PA (US); Timothy C. Morris, Morton, PA (US)

(73) Assignee: Cognis Corporation, Cincinnati, OH (US)

( * ) Notice: Subject to any disclaimer, the term of this patent is extended or adjusted under 35 U.S.C. 154(b) by 3 days.

This patent is subject to a terminal disclaimer.

(21) Appl. No.: 10/736,190

(22) Filed: Dec. 15, 2003

Related U.S. Application Data

(60) Provisional application No. 60/440,986, filed on Jan. 17, 2003.

(51) Int. Cl.

| | |
|---|---|
| ***C11D 1/83*** | (2006.01) |
| ***C11D 3/44*** | (2006.01) |
| ***C11D 3/22*** | (2006.01) |
| ***C11D 17/00*** | (2006.01) |
| ***B08B 3/04*** | (2006.01) |

(52) U.S. Cl. ..... 510/365; 510/199; 510/238; 510/239; 510/240; 510/417; 510/426; 510/473; 510/492; 510/506; 134/25.2; 134/25.3; 134/39; 134/40; 134/42

(58) Field of Classification Search ..... 510/199, 510/238, 239, 240, 365, 417, 426, 473, 492, 510/506; 134/25.2, 25.3, 39, 40, 42
See application file for complete search history.

(56) References Cited

U.S. PATENT DOCUMENTS

| | | | | |
|---|---|---|---|---|
| 5,952,287 | A | 9/1999 | Gross et al. | |
| 5,990,072 | A | 11/1999 | Gross et al. | |
| 6,224,685 | B1 | 5/2001 | Gross et al. | |
| 6,821,937 | B1 * | 11/2004 | Gross | 510/365 |
| 6,824,623 | B1 * | 11/2004 | Gross et al. | 134/36 |

* cited by examiner

*Primary Examiner*—Brian P. Mruk
(74) *Attorney, Agent, or Firm*—John F. Daniels; Daniel S. Ortiz

(57) ABSTRACT

A cleaning composition containing: (a) from about 1.0 to about 15.0% by weight of an anionic surfactant; (b) from about 3 to about 50% by weight of a $C_6$–$C_{14}$ methyl ester primary solvent; (c) from about 1.0 to about 15.0% by weight of a short-chain cosurfactant; (d) from about 1 to about 25% by weight of a polar solvent having a water solubility of from about 1 to 5 g/100 ml; (e) up to about 10.0% by weight of a nonionic surfactant; (f) from about 0.05 to about 3.0% by weight of a thickening agent selected from the group consisting of hydroxypropyl cellulose, hydroxypropyl methylcellulose, and mixtures thereof; and (g) remainder, water, all weights being based on the total weight of the composition, and wherein the composition is terpene-free.

28 Claims, No Drawings

THICKENERS FOR METHYL ESTER MICROEMULSIONS

CROSS-REFERENCE TO RELATED APPLICATIONS

This application claims the benefit of copending provisional application Ser. No. 60/440,986 filed on Jan. 17, 2003.

STATEMENT REGARDING FEDERALLY SPONSORED RESEARCH OR DEVELOPMENT:

Applicable.

BACKGROUND OF THE INVENTION

The present invention generally relates to a cleaning composition. More particularly, the invention relates to a novel cleaning formulation having superior cleaning ability which is readily biodegradable, low in toxicity and volatility, neutral in pH and primarily naturally derived.

General purpose household cleaning compositions for hard surfaces such as metal, glass, ceramic, plastic and linoleum surfaces are commercially available in both powdered and liquid form. Powdered cleaning compositions consist mainly of builder or buffering salts such as phosphates, carbonates, and silicates and although such composition may display good inorganic soil removal, they exhibit inferior cleaning performance on organic soils such as greasy/fatty/oily soils.

Liquid cleaning compositions, on the other hand, have the great advantage that they can be applied onto hard surfaces in a neat or concentrated form so that a relatively high level of surfactant material is delivered directly to the soil. Moreover, it is a rather more straightforward task to incorporate high concentrations of anionic or nonionic surfactant in a liquid rather than a granular composition. For both of these reasons, therefore, liquid cleaning compositions have the potential to provide superior grease and oily soil removal over powdered cleaning compositions.

Nevertheless, liquid cleaning compositions suffer a number of drawbacks which can limit their consumer acceptability. They generally contain little or no detergency builder salts and consequently they tend to have poor cleaning performance on particulate soil and also lack effectiveness under varying water hardness levels. In addition, they can suffer problems relating to homogeneity, clarity, and viscosity when used by consumers. Moreover, the higher in-use surfactant concentration necessary for improved grease and soil removal causes further problems relating to extensive suds formation which requires frequent rinsing and wiping on the part of the consumer.

One solution to the above-identified problems has involved the use of saturated and unsaturated terpenes, in combination with a polar solvent, in order to increase the cleaning effectiveness of the hard surface cleaner and control sudsing. A problem associated with the use of terpenes such as, for example, d-limonene, is that their price, as a raw material, tends to fluctuate wildly. Consequently, the cost to manufacture hard surface liquid cleaners containing terpene solvents is financially disadvantageous to both producers and consumers.

Other solvents which are often employed in hard surface cleaning compositions, instead of terpenes, include those derived from aliphatic, aromatic and halogenated hydrocarbons. Their use, however, is undesirable for environmental reasons due to their limited biodegradation.

Consequently, oil-continuous alkyl ester microemulsions, which are terpene-free, have emerged as a viable option for use in cleaning hard surfaces. These microemulsions are safe and highly-effective at removing graffiti, paint, adhesives, grease, and printing inks from various types of hard surface substrates. When using these methyl ester microemulsions, it is oftentimes desirable that they possess vertical surface cling in order to increase their dwell time on vertical surfaces requiring cleaning.

Microemulsions are optically transparent and thermally stable. This being the case, the use of surfactant thickeners is not an option due to their directly negatively affecting the hydrophilicity of the emulsifier system, thereby destabilizing the optimized formulation. Similarly, colloidal thickeners are also not suitable for use in methyl ester microemulsions because they result in a loss of transparency and sedimentation.

While hydrophibically modified cellulosic gums have been found to thicken oil-continuous methyl ester microemulsions, they impart a hazy appearance to, and eventually precipitate out of, the microemulsion.

It is therefore an object of the present invention to provide a thickened alkyl ester microemulsion which possesses vertical surface cling without any of the above-noted attendant disadvantages.

BRIEF SUMMARY OF THE INVENTION

It has been surprisingly discovered that by making the solvent phase more polar through the replacement of a portion of the alkyl ester with a polar solvent, and also by reducing the oil:water ratio, a hydrophibically modified cellulosic gum can be completely solubilized in the system, resulting in a stable, transparent, viscous microemulsion. The present invention is thus directed to a terpene-free cleaning composition containing:

(a) from about 1.0 to about 15.0% by weight of an anionic surfactant selected from the group consisting of an oil-soluble anionic surfactant, a water-soluble anionic surfactant, and mixtures thereof (b) from about 3 to about 50% by weight of a $C_6$–$C_{14}$ alkyl ester primary solvent;

(c) from about 1.0 to about 15.0% by weight of a short-chain cosurfactant;

(d) from about 1 to about 25% by weight of a polar solvent having a water solubility of from about 1 to about 10 g/l 00 ml;

(e) up to about 10.0% by weight of a nonionic surfactant;

(f) from about 0.05 to about 3.0% by weight of a thickening agent selected from the group consisting of hydroxypropyl cellulose, hydroxypropyl methylcellulose, and mixtures thereof; and (g) remainder, water, all weights being based on the total weight of the composition.

The present invention is also directed to a process for cleaning a hard surface substrate involving contacting the substrate with a cleaning-effective amount of the above-disclosed terpene-free cleaning compositions.

BRIEF DESCRIPTION OF THE SEVERAL VIEWS OF THE DRAWING

Not applicable.

DETAILED DESCRIPTION OF THE INVENTION

Other than in the operating examples, or where otherwise indicated, all numbers expressing quantities of ingredients or reaction conditions used herein are to be understood as being modified in all instances by the term "about".

The removal of undesirable aged paints, coatings, greases, and the like from various substrates is accomplished by two mechanisms, namely, dissolution and lifting. Dissolution is when the undesirable material is dissolved from the substrate by a solvent. Lifting is when the solvent penetrates into the undesirable material and causes it to swell. As a result of the swelling, the material, whether it be a paint, coating or the like, wrinkles and lifts (separates) from the substrate, allowing it to then be easily removed from the substrate's surface.

The removal of such undesirable materials from vertical substrates requires the use of a cleaning composition capable of vertical surface cling. It has surprisingly been discovered that an alkyl ester microemulsion in general, and a methyl ester microemulsion in particular, free of terpenes, which possesses both dissolution and lifting mechanisms, along with vertical surface cling, can be formulated by adding an effective amount of certain thickeners and polar solvents to the microemulsion.

According to the invention, the solvent phase is first made more polar by replacing a portion of the alkyl ester with a more polar solvent such as, for example, benzyl alcohol, ethylene glycol phenyl ether, propylene glycol phenyl ether, 1-hexanol, and mixtures thereof. This alone, however does not facilitate complete solubility of the cellulosic gum thickener in the finished microemulsion. It is also necessary to increase the amount of the aqueous internal phase, thereby decreasing the amount of continuous solvent phase. These measures result in both the complete solubility of the cellulosic gum thickener in the finished microemulsion, as well as a reduction in the total amount of emulsifiers required to form a stable microemulsion.

Suitable oil-soluble anionic surfactants which may be employed in the present invention include, but are not limited to, amine salts of dodecylbenzenesulfonic acid, calcium salts of dodecylbenzenesulfonic acid, and phosphate esters. A particularly preferred oil-soluble anionic surfactant is the isopropylamine salt of dodecylbenzenesulfonic acid.

Suitable water-soluble anionic surfactants which may be employed in the present invention include, but are not limited to, water-soluble salts of alkyl benzene sulfonates, alkyl sulfates, alkyl polyethoxy ether sulfates, paraffin sulfonates, alpha-olefin sulfonates and sulfosuccinates, alpha-sulfocarboxylates and their esters, alkyl glyceryl ether sulfonates, fatty acid monoglyceride sulfates and sulfonates, and alkyl phenol polyethoxyether sulfates.

Other suitable water-soluble anionic surfactants include the water-soluble salts or esters of alpha-sulfonated fatty acids containing from about 6 to about 20 carbon atoms in the fatty acid group and from about 1 to about 10 carbon atoms in the ester group.

Particularly preferred anionic surfactants for use in the present invention include the isopropylamine salt of a $C_{10-14}$ linear alkylbenzene sulfonic acid, and/or a $C_{8-14}$ fatty alcohol sulfate.

In the event that an anionic surfactant is employed, it will typically be present in the composition in an amount of from about 1.0 to about 15.0% by weight, preferably from about 5.0 to about 12.0% by weight, and most preferably from about 7.0 to about 10.0% by weight, based on the weight of the composition.

The primary solvent used in the present invention is a $C_{1-4}$ alkyl ester of a $C_{6-22}$ saturated or unsaturated carboxylic acid. The use of an alkyl ester as a solvent in cleaning compositions is significantly more desirable than conventional solvents, such as terpenes and hydrocarbon derivatives, for both environmental and economic reasons.

A preferred $C_{1-4}$ alkyl ester of a $C_{6-22}$ saturated or unsaturated carboxylic acid for use in the present invention is a methyl ester corresponding to formula I:

$$R_1COOCH_3 \quad (I)$$

wherein $R_1$ is an alkyl radical having from about 6 to about 14 carbon atoms. They are derived by the esterification of a fatty acid with methanol. Particularly preferred methyl esters are those derived from the esterification of unsaturated fatty acids having from about 12 to about 14 carbon atoms. Suitable fatty acids from which the fatty acid esters may be derived include, but are not limited to, coconut and other vegetable oils, tallow, etc.

Suitable nonionic surfactants which may be employed in the present invention include, but are not limited to, alkyl polyglycosides, polyethylene oxide condensates of alkyl phenol having an alkyl group containing from about 6 to about 12 carbon atoms in either straight or branched-chain configuration, the ethylene oxide being present in amounts equal to from 5 to 25 moles of ethylene oxide per mole of alkyl phenol.

Condensation products of primary or secondary alcohols having from 8 to 24 carbon atoms, with from 1 to about 30 moles of alkylene oxide per mole of alcohol may also be employed.

Suitable short-chain co-surfactants for use in the present invention include, but are not limited to, $C_2$–$C_5$ alcohols, glycols, glycol ethers, pyrrolidones and glycol ether esters. A particularly preferred short-chain cosurfactant is propylene glycol n-butyl ether.

Suitable polar solvents for use in the present invention include those having a water solubility of from about 1 to about 10 g/100 ml, preferably from about 1 to about 5 g/100 ml, and most preferably from about 2 to about 3 g/100 ml. Examples thereof include, but are not limited to, benzyl alcohol, normal hexanol and glycol phenyl ethers. A particularly preferred polar solvent is benzyl alcohol.

The thickening agents which may be employed by the present invention are, in general, low viscosity polymers. Examples thereof include methyl cellulose (MC), microcrystalline cellulose (MCC), povidone (PVP), pre-gelatinized starch (Starch), hydroxypropyl cellulose (H PC), hydroxypropyl methylcellulose (HPMC), and combinations thereof.

According to one embodiment of the present invention, there is provided a terpene-free cleaning composition, having improved vertical surface cling, containing: (a) from about 1.0 to about 15.0% by weight, preferably from about 5.0 to about 12.0% by weight, and most preferably from about 7.0 to about 10.0% by weight, of an anionic surfactant, (b) from about 3 to about 50% by weight, preferably from about 10.0 to about 35% by weight, and most preferably from about 12 to about 25% by weight, of a $C_{1-4}$ alkyl ester, preferably a $C_6$–$C_{14}$ methyl ester solvent, (c) up to about 10% by weight, preferably from about 1.0 to about 6.0% by weight, and most preferably from about 2.0 to about 4.0% by weight, of a nonionic surfactant, (d) from about 1.0 to about 15.0% by weight, preferably from about 5.0 to about 12.0% by weight, and most preferably from about 7.0 to about 10.0% by weight, of a short-chain cosurfactant, (e) from about 1 to about 25% by weight, preferably from about 3 to about 15% by weight, and most preferably from about 6 to about 10% by weight of a polar solvent having a water solubility of from about 1 to about 5 g/100 ml; from about 0.05 to about 3.0% by weight, preferably from about 0.10 to about 1.5% by weight, and most preferably from about 0.20 to about 0.70% by weight, of a thickening agent, and (f) remainder, water, all weights being based on the total weight of the composition.

Since methyl esters are subject to hydrolysis under alkaline conditions, it is imperative that the pH of the hard-surface cleaning composition be less than about 9, and preferably in the range of from about 6 to about 9.

The thickened terpene-free cleaning composition of the present invention may be employed as either a neat solution or a microemulsion. Its use as a microemulsion, however, affords it the greatest degree of cost and performance. In this form it is an oil continuous microemulsion characterized by a high level of thermal stability, ranging from about 10 to about 70° C. However, in order to achieve this level of thermal stability, the methyl ester component and water should be present in the composition in a ratio by weight of from about 50:1 to about 1:4, preferably from about 5:1 to about 1:2, and most preferably about 1.5–3:1.

Auxiliaries may be incorporated into the cleaning composition of the present invention without departing from the spirit thereof. Examples of suitable auxiliaries which may be used include, but are not limited to, amphoteric surfactants, zwitterionic surfactants, pH buffering agents, corrosion inhibitors dyes, perfumes, enzymes, preservatives, hydrotropes, and the like.

According to another embodiment of the present invention, there is provided a process for cleaning a hard surface involving contacting the hard surface with the above-disclosed composition.

The cleaning compositions according to the invention can be used in a wide variety of applications which include, but are not limited to, the removal of grease, oil, ink, chewing gum and paint from hard and porous surfaces including all kinds of natural and synthetic fabrics in both industrial-institutional and consumer applications. Examples of the disparate types of applications include, but are not limited to, the use of the cleaning compositions according to the invention as water rinsable paint brush cleaners for brushes having both natural and synthetic bristles. Another use is as a cleaner for human skin and nails such as hand and finger nail cleaner for the removal of paints, greases, glues, nail polish and the like. The cleaning compositions according to the invention can also be used as a spot cleaner for removing grease, oil and paints from carpets and rugs and as a prespotter in laundry applications for the removal of stains from fabrics. Other applications include the removal of grease such as lithium and molybdenum greases from steel and concrete surfaces such as, for example, wheel bearings or garage floors having grease and oil stained tire tracks and the like. The cleaning compositions according to the invention can also be used to clean the concrete and metal surfaces of off-shore oil drilling platforms.

The cleaning compositions according to the invention can also contain an effective amount of odor masking agents such as natural products, for example, essential oils; aroma chemicals; perfumes and the like. Examples of natural products include, but are not limited to, ambergris, benzoin, castoreum, civet, clove oil, galbanum, jasmine, rosemary oil, sandalwood, and the like. Examples of aroma chemicals include, but are not limited to, isoamyl acetate (banana); isobutyl propionate (rum); methyl anthranilate (grape); benzyl acetate (peach); methyl butyrate (apple); ethyl butyrate (pineapple); octyl acetate (orange); n-propyl acetate (pear); ethyl phenyl acetate (honey). The cleaning compositions according to the invention can contain any combination of the above types of compounds. An effective amount of such odor masking agents in the cleaning compositions according to the invention is any amount necessary to produce an odor masking effect or reduce an unwanted odor to an acceptable level. Such an amount will be readily determinable by those skilled in the art. The amount of odor masking agent will typically vary from about 0.25% to about 2.5% by weight of the cleaning composition with the preferred amount being from about 0.4% to about 1%.

An in-can corrosion problem can arise when the cleaning compositions according to the invention are packaged in cans. Cans, and particularly aerosol cans, are generally made from steel and are, therefore, susceptible to corrosion by products containing water. Products containing water, such as the composition according to the invention, require the addition of a corrosion inhibitor to prevent corrosion of the can and contamination of the formulation in the can. When the formulation according to the invention is in the form of a microemulsion, the microemulsion is susceptible to destabilization by the addition of ions to the formulation. It is therefore necessary to use a corrosion inhibitor that will not contribute to the destabilization of the microemulsion. Corrosion inhibitors that are compatible with the microemulsion composition according to the invention must be selected such that they do not contribute an amount of ions to the formulation that will destabilize the microemulsion. Preferably the inhibitor will be a molecule that has both an oil soluble portion and a water soluble portion. It has been found that an amphoteric surfactant containing an amine functionality in an amount of from about 0.05% to about 2% by weight, and preferably from about 0.25% to about 1.0%, acts as a corrosion inhibitor when combined with the microemulsion composition according to the invention, does not break the microemulsion and is effective in prevention of corrosion. Examples of suitable corrosion inhibitors include the DERIPHAT® amphoteric surfactants, particularly advantageous is DERIPHAT® 151-C, available from Cognis Corporation, Ambler Pa. Other corrosion inhibitors that can be used with the composition according to the invention include, but are not limited to, amine soaps of fatty acids and fatty alkanolamides such as the $C_8$ to $C_{18}$ fatty alkanolamides, examples of which include STANDAMID® alkanolamides, available from Cognis Corporation. Such corrosion inhibitors can also be used for post-application anti-corrosion effects on surfaces that will rust or corrode because of the presence of water in the cleaning compositions according to the invention such as on metal surfaces such as iron and steel and the like. The amount of the corrosion inhibitors required for post-application purposes is any amount effective to inhibit or prevent corrosion of a metal surface onto which the cleaning compositions according to the invention are applied.

The present invention will be better understood by the examples which follow, all of which are intended for illustrative purposes only, and are not meant to unduly limit the scope of the invention in any way. Unless otherwise indicated, percentages are on a weight-by-weight basis.

EXAMPLES

A thickened methyl ester microemulsion cleaning composition was prepared in accordance with the present invention. Its formulation is found below.

| Component | % wt. |
|---|---|
| $C_{8-10}$ methyl ester | 16.0 |
| benzyl alcohol | 7.0 |
| isopropylamine salt of LAS acid | 6.5 |
| propylene glycol n-butyl ether | 6.0 |
| sodium lauryl sulfate | 1.2 |
| n-octyl sulfate | 1.4 |
| hydroxy propyl methyl cellulose | 0.3 |
| water | remainder to 100% |

What is claimed is:

1. A composition comprising:

(a) from about 1.0 to about 15.0% by weight of an anionic surfactant;

(b) from about 3 to about 50% by weight of a $C_{1-4}$ alkyl ester of a $C_{6-22}$ saturated or unsaturated carboxylic acid primary solvent;

(c) from about 1.0 to about 15.0% by weight of a short-chain cosurfactant;

(d) from about 1 to about 25% by weight of a polar solvent having a water solubility of from about 1 to about 5 g/100 ml;

(e) up to about 10.0% by weight of a nonionic surfactant;

(f) from about 0.05 to about 3.0% by weight of a thickening agent selected from the group consisting of hydroxypropyl cellulose, hydroxypropyl methylcellulose, and mixtures thereof; and (f) remainder, water, and optionally auxiliaries all weights being based on the total weight of the composition.

2. The composition of claim 1 wherein the composition is terpene-free.

3. The composition of claim 1 wherein the anionic surfactant is present in the composition in an amount of from about 7.0 to about 10.0% by weight, based on the weight of the composition.

4. The composition of claim 1 wherein the anionic surfactant comprises an isopropylamine salt of a linear alkylbenzene sulfonic acid.

5. The composition of claim 1 wherein the primary solvent comprises a $C_{6-14}$ methyl ester present in the composition in an amount of from about 18.0 to about 22.0% by weight, based on the weight of the composition.

6. The composition of claim 1 wherein the primary solvent comprises a $C_{12-14}$ methyl ester.

7. The composition of claim 1 wherein short chain cosurfactant is present in the composition in an amount of from about 7.0 to about 10.0% by weight, based on the weight of the composition.

8. The composition of claim 1 wherein the short-chain co-surfactant is propylene glycol n-butyl ether.

9. The composition of claim 1 wherein the nonionic surfactant is present in the composition in an amount of from about 2.0 to about 4.0% by weight, based on the weight of the composition.

10. The composition of claim 1 wherein the nonionic surfactant comprises an alkoxylate $C_{12-14}$ fatty alcohol alkoxylated with 3 moles of ethylene oxide and 6 moles of propylene oxide.

11. The composition of claim 1 wherein the thickening agent is present in the composition in an amount of from about 0.25 to about 0.50% by weight, based on the weight of the composition.

12. The composition of claim 1 wherein the thickening agent comprises hydroxypropyl cellulose.

13. The composition of claim 1 wherein the polar solvent comprises a member selected from the group consisting of benzyl alcohol, n-hexanol, a glycol phenyl ether, and mixtures thereof.

14. The composition of claim 1 wherein the polar solvent is present in the composition in an amount of from about 6 to about 10% by weight, based on the weight of the composition.

15. A process for cleaning a hard surface comprising contacting the surface with a composition containing:

(a) from about 1.0 to about 15.0% by weight of an anionic surfactant;

(b) from about 3 to about 50% by weight of a $C_{1-4}$ alkyl ester of a $C_{8-22}$ saturated or unsaturated carboxylic acid primary solvent;

(c) from about 1.0 to about 15.0% by weight of a short-chain cosurfactant;

(d) from about 1 to about 25% by weight of a polar solvent having a water solubility of from about 1 to about 5 g/l 00 ml;

(e) up to about 10.0% by weight of a nonionic surfactant;

(f) from about 0.05 to about 3.0% by weight of a thickening agent selected from the group consisting of hydroxypropyl cellulose, hydroxypropyl methylcellulose, and mixtures thereof; and (f) remainder, water, and auxiliaries all weights being based on the total weight of the composition.

16. The process of claim 15 wherein the composition is terpene-free.

17. The process of claim 15 wherein the anionic surfactant is present in the composition in an amount of from about 7.0 to about 10.0% by weight, based on the weight of the composition.

18. The process of claim 15 wherein the anionic surfactant comprises an isopropylamine salt of a linear alkylbenzene sulfonic acid.

19. The process of claim 15 wherein the primary solvent comprises a $C_{6-14}$ methyl ester present in the composition in an amount of from about 18.0 to about 22.0% by weight, based on the weight of the composition.

20. The process of claim 15 wherein the primary solvent comprises a $C_{12-14}$ methyl ester.

21. The process of claim 15 wherein short chain cosurfactant is present in the composition in an amount of from about 7.0 to about 10.0% by weight, based on the weight of the composition.

22. The process of claim 15 wherein the short-chain co-surfactant propylene glycol n-butyl ether.

23. The process of claim 15 wherein the nonionic surfactant is present in the composition in an amount of from about 2.0 to about 4.0% by weight, based on the weight of the composition.

24. The process of claim 15 wherein the nonionic surfactant comprises an alkoxylate $C_{12-14}$ fatty alcohol alkoxylated with 3 moles of ethylene oxide and 6 moles of propylene oxide.

25. The process of claim 15 wherein the thickening agent is present in the composition in an amount of from about 0.25 to about 0.50% by weight, based on the weight of the composition.

26. The process of claim 15 wherein the thickening agent comprises hydroxypropyl cellulose.

27. The process of claim 15 wherein the polar solvent comprises a member selected from the group consisting of benzyl alcohol, n-hexanol, a glycol phenyl ether, and mixtures thereof.

28. The process of claim 15 wherein the polar solvent is present in the composition in an amount of from about 6 to about 10% by weight, based on the weight of the composition.

* * * * *